US006935911B1

(12) United States Patent
Stewart et al.

(10) Patent No.: US 6,935,911 B1
(45) Date of Patent: Aug. 30, 2005

(54) AQUATIC ALARM, SECURITY AND RESCUE STATION

(76) Inventors: Kristin L Stewart, 1114 Maldonado Ave., Pensacola Beach, FL (US) 32561; Sandra Stewart, 23 Seashore Dr., Pensacola Beach, FL (US) 32561

( * ) Notice: Subject to any disclaimer, the term of this patent is extended or adjusted under 35 U.S.C. 154(b) by 0 days.

(21) Appl. No.: 10/761,959

(22) Filed: Jan. 19, 2004

Related U.S. Application Data

(60) Provisional application No. 60/470,190, filed on May 14, 2003.

(51) Int. Cl.[7] ..... B63C 9/08
(52) U.S. Cl. ..... 441/81; 441/89
(58) Field of Search ..... 441/81, 89

(56) References Cited

U.S. PATENT DOCUMENTS

| | | | | |
|---|---|---|---|---|
| 391,376 | A | 10/1888 | MacFarlane | |
| 583,221 | A | 5/1897 | Archibald | |
| 947,446 | A | 1/1910 | Lenz | |
| 1,773,462 | A | 8/1930 | Lambdin | |
| 2,111,309 | A | 3/1938 | Blow | |
| 2,260,109 | A | 10/1941 | Amdal | |
| 2,690,152 | A | 9/1954 | Riccio | |
| 3,099,845 | A | 8/1963 | Chamberlain | |
| 3,675,257 | A | 7/1972 | Haglund et al. | |
| 3,754,291 | A | 8/1973 | Harris et al. | |
| 3,945,067 | A | 3/1976 | Salvarezza | |
| 4,033,276 | A | 7/1977 | Barr | |
| 4,155,132 | A | 5/1979 | Lee | |
| 4,577,262 | A | 3/1986 | Buteaux | |
| 4,702,715 | A | 10/1987 | Winick | |
| 4,841,892 | A | 6/1989 | Pugh | |
| 5,257,954 | A * | 11/1993 | Mullisen et al. | 441/89 |
| 6,195,039 | B1 * | 2/2001 | Glass, Jr. | 342/357.09 |

FOREIGN PATENT DOCUMENTS

| | | |
|---|---|---|
| CA | 1.206.042 | 6/1986 |
| GB | 2.085.812 | 5/1982 |

* cited by examiner

*Primary Examiner*—Stephen Avila
(74) *Attorney, Agent, or Firm*—Michael I. Kroll

(57) ABSTRACT

An aquatic rescue apparatus including a base, housing connected to the base which includes at least one alarm mechanism contained therein, a triggering mechanism positioned on the housing and connected to the alarm mechanism, and a flotation device releasably connected to the triggering mechanism. Upon the flotation device being removed from the triggering mechanism, at least one alarm mechanism emits an alarm signal indicative of an aquatic emergency.

14 Claims, 12 Drawing Sheets

AQUATIC ALARM, SECURITY AND RESCUE STATION

RELATED APPLICATIONS

This application is subject to U.S. provisional application Ser. No. 60/470,190, filed 14 May 2003. Please incorporate by reference all information in said provisional application into this instant application.

BACKGROUND OF THE INVENTION

1. Field of the Invention

The present invention relates generally to aquatic equipment and, more specifically, to an aquatic rescue station having life saving equipment for helping a person in distress in an aquatic environment. The aquatic rescue station includes a flotation device that is selectively detachable from a base that is located on a support pole securely positioned at or near the body of water. Upon selectively detaching the flotation device from the base, a plurality of alarm mechanisms are activated for notifying both people in the immediate vicinity and other public servants that there is a water emergency in progress and that a person is in distress. The alarm mechanisms can be at least one of visual, audible, and via radio frequency.

2. Description of the Prior Art

While flotation devices for use in water emergencies are well known and have been in use for many years, these flotation devices are generally kept by lifeguards and those charged with the responsibility of guarding bodies of water. It has been noted that in many cases of drowning that the mere presence of a flotation device specifically intended for assisting a swimmer in distress would likely have prevented these tragedies from occurring. Thus, it is desirable to have life saving flotation devices positioned along the unguarded sections of various bodies of water. However, there exists a problem whereby these flotation devices are light and extremely portable and that such life saving apparatus can be easily stolen or tampered with thus reducing the effectiveness in aiding in a water emergency. The present invention creates an apparatus which allows for the desired placement of life saving flotation devices along unguarded sections of a body of water while including anti-theft mechanism which would ensure that the life saving flotation devices would not be misused or stolen.

Numerous other types of Aquatic alarms, security and rescue stations exist in the prior art. Typical of these are U.S. Pat. Nos. 391,376, 2,111,309, 3,675,257, 4,155,132, 583, 221, 2,260,109, 3,754,291, 4,577,262, 947,446, 2,690,152, 3,945,067, 4,702,715, 1,773,462, 3,099,845, 4,033,276, 4,841,892, United Kingdom Patent No. GB2085812 and Canadian Patent No. CA1206042. While these aquatic devices may be suitable for the purposes for which they were designed, they would not be as suitable for the purposes of the present invention, as hereinafter described.

U.S. Pat. No. 391,376

Inventor: John MacFarlane

Issued: Oct. 16, 1888

The invention is in the nature of a rack for continuing or holding life-preservers on vessels, and an alarm connected therewith.

U.S. Pat. No. 2,111,309

Inventor: Capitola E. Blow

Issued: Mar. 15, 1938

The present invention relates to new and useful improvements in life preserver holders of the type generally similar to that constituting the subject matter of U.S. Pat. No. 924,881, issued on Jun. 15, 1909.

U.S. Pat. No. 3,675,257

Inventor: Bernard F. Haglund

Issued: Jul. 11, 1972

A quick-release device for storing a ring buoy. Spacing a support means secure the device to a bulkhead extending transversely to the fore-and-aft line of a ship. A stationary frame supported by the spacing and support means provides a vertical end wall, a horizontal bottom portion having pivot means spaced from the end wall, a horizontal bottom portion having pivot means spaced from the end wall, and a horizontal upper portion. The ring buoy rests against the end wall and is held there normally by a swingable ramp pivoted to the pivot means with its center of gravity well beyond the pivot means on the opposite side thereof from the end wall. This ramp has a short bottom wall portion, an inclined portion, and an end portion, which during stowage is substantially vertical, and when it is vertical, it snugly holds the ring buoy, with the ring buoy resting on the ramp's bottom and inclined portions and against the end portion. The ramp means also has guide means for retaining the ring buoy in proper position so that it will not fall to one side. Latch and release means supported by said horizontal upper portion, holds the upper edge of the ramp when its end portion is in a vertical position. A simple upward pull releases the edge of the ramp, whereby it seeks its natural provides a ramp pathway projecting the ring buoy out and away from a vertical drop and casing it to describe a trajectory that frees it from the ship.

U.S. Pat. No. 4,155,132

Inventor: William W. A. Lee

Issued: May 22, 1979

Rescue apparatus comprising a life belt, a housing support for said life belt, adapted to be mounted in a substantially erect manner, releasable retaining apparatus for retaining said life belt in juxtaposition to said housing support, and remote release apparatus whereby operation of the remote release apparatus releases the retaining apparatus to cause or allow the life belt to become detached from the housing support.

U.S. Pat. No. 583,221

Inventor: William W. A. Lee

Issued: May 22, 1979

A container for storage on an offshore work site. A lightweight metal container is provided with a latching mechanism which is operable by hand or foot pressure for allowing opening of the container. The container has attached thereto a spring loaded assembly for causing automatic opening of the top upon release of the latching mechanism from the top. A power source, switch and lamp are attached to the container for automatic illumination of the contents therein upon opening of the top.

U.S. Pat. No. 583,221

Inventor: Rupert Archibald

Issued: May 25, 1897

This invention has relation to an improvement in life-saving at sea; and its object is to furnish a means of unshipping the life-buoy and the rescue-signal which is attached to the buoy, simultaneously in the case of a man overboard. To enable a drowning man to find the buoy at night or in a rough sea, the flame of the ordinary rescue-signal when attached by a line to the buoy, has been of material assistance; but to attach the signal and pierce it at both ends for use takes some time, and the chance of saving the man is considerably reduced.

U.S. Pat. No. 2,260,109

Inventor: Hans Amdal

Issued: Oct. 21, 1941

This invention relates to life buoys and particularly to means for operating the same.

U.S. Pat. No. 3,754,291

Inventor: John L. Harris et al.

Issued: Aug. 28, 1973

Life saving equipment in which a life buoy is disposed in a container having a fall-away construction defined by pivotal connections between a front wall and bottom wall and between a rear wall and the bottom wall. A remote cable release interconnects a latching component on the front wall and stationary portion of the container. A float pole is connected by a line to the life buoy and disposed in the container for substantially simultaneous release with the life buoy. The life buoy is formed with ends curved in horseshoe manner and a drogue and signal generator, connected by a line to the life buoy, may be stored between the buoy ends.

U.S. Pat. No. 4,577,262

Inventor: Leonard J. Buteaux

Issued: Mar. 18, 1986

A container for storage on an offshore work site. A lightweight metal container is provided with a latching mechanism which is operable by hand or foot pressure for allowing opening of the container. The container has attached thereto a spring loaded assembly for causing automatic opening of the top upon release of the latching mechanism from the top. A power source, switch and lamp are attached to the container for automatic illumination of the contents therein upon opening of the top.

U.S. Pat. No. 947,446

Inventor: Charles S. Lenz

Issued: Jan. 25, 1910

This invention relates to racks for holding life buoys, the object of the invention being to provide a simple buoy holder by means of which the buoy may be conveniently attached to and supported by the rack or holder and instantly removed therefrom when needed for use.

U.S. Pat. No. 2,690,152

Inventor: Joseph G. A. Riccio

Issued: Sep. 28, 1954

This invention relates to improvements in racks for holding life buoy equipment and it has for its primary object to provide a rack unit of the class described which will normally hold both a life buoy ring and its throw-line in compactly assembled relationship and in such manner that they are always accessible for expeditious removal and use.

U.S. Pat. No. 3,945,067

Inventor: Charles S. Lenz

Issued: Jan. 25, 1019

A quick-release device for storing a ring buoy and life-buoy markers. The ring buoy rests against the end wall of a frame and is normally held there by a swingable pivoted ramp with its center of gravity well beyond the pivot. When stowed, the ramp snugly holds the ring buoy. The ramp also carries open-top, closed-bottom holders for lifebuoy markers. The markers may include a light signal and a smoke signal, both having actuators connected to a painter line, which is likewise stowed. A simple upward pull on a latch releases the ramp to seek its natural center of gravity, swinging out around its pivot providing a ramp pathway projecting the ring buoy out and away from a vertical drop and causing it to describe a trajectory that frees it from the ship. At the same time, the device both ejects and actuates the lifebuoy markers.

U.S. Pat. No. 4,702,715

Inventor: Alan L. Winick

Issued: Oct. 27, 1987

An automatic rescue apparatus for deploying a flotation device. The unit can be mounted vertically on the rail of a vessel or horizontally on the deck. The rescue apparatus has a life ring, a launcher housing containing a radio receiver and a trigger device and incorporating a life ring launching arm, a housing containing a collapsed inflatable marker buoy and a CO.sub.2 inflation assembly, and a portable battery-powered transmitter worn by an individual on a vessel. Ejection and resulting inflation of the marker buoy as well as simultaneous deployment of the life ring are actuated by a radio signal received from the transmitter worn by the overboard person.

U.S. Pat. No. 1,773,462

Inventor: Howard B. Lambden

Issued: Aug. 19, 1930

The present invention is directed to improvements in devices for launching buoys.

U.S. Pat. No. 3,099,845

Inventor: Clair J. Chamberlain

Issued: Aug. 6, 1963

This invention relates generally to life saving apparatus, and has particular reference to a device for holding the line for a ring buoy pre-coiled for instant use.

U.S. Pat. No. 4,033,276

Inventor: Douglas Barr

Issued: Jul. 5, 1977

A support is disclosed for retaining a life ring and its associated line in a ready position for emergency use and includes a frame having vertically slidable portions adapted to be held in a spaced apart open position by the insertion of the life ring between outwardly extending members thereof and adapted to move towards each other when the life ring is removed therefrom so as to reduce the overall height of the frame member and thus enable a retaining line coiled thereabouts in a relatively taut storage attitude to be loosely suspended from the top portion thereof in a relatively closed or emergency use position.

U.S. Pat. No. 4,841,892

Inventor: Billy G. Pugh

Issued: Jun. 27, 1989

A shelter for a life ring buoy which includes a support for the life ring and a cover wherein the cover has weight secured thereto. The weight, in combination with easy release fasteners on the support secures the cover to the support. The fasteners include open slot fasteners which receive the body of the cable and two closed fasteners which receive the ends of the cable. When the life ring is needed, the cover is easily lifted from the support exposing the life ring.

United Kingdom Patent Number GB 2085812

Inventor: Lewis Peter

Issued: Jun. 5, 1989

Apparatus for retaining and releasing a distress marker such as a buoy (not shown) comprises a container for receiving the marker (3), closure means (14) for holding the container closed under normal conditions, means (8) for ejecting the marker from the container on release of the closure means, and means for releasing the closure means on occurrence of a distress condition.

Canadian Patent Number 1,206,042

Inventor: Joseph E. Bissig

Issued: Jul. 1, 1986

The rescue-unit includes a housing containing, a folded floating element and a bottle of compressed gas for automatic inflation of the floating element in the water. Inflation is initiated as soon as disc-like support-elements, placed on edge, become soft and buckle, when water enters, and thus no longer prevent actuation of a valve loaded by a spring located below the bottle of compressed gas. The spring can be completely released, for the purpose of actuating the valve of the compressed-gas bottle, only when a locking element, projecting into a preloading device loaded by the spring, is removed. The locking element is firmly connected to a retainer in which the housing is secured. When the housing is withdrawn from the retainer, the preloading device is automatically unlocked, leaving the rescue-unit ready for automatic inflation of the floating element as soon as the water gains access to the support-elements. The latter may also be destroyed by pulling on a cord, which allows the floating element to be inflated immediately by the bottle of compressed gas. In an emergency, this allows a person to put on the floating element before jumping into the water. The floating element is itself in the form of a U-shaped collar encircling the person's neck only.

SUMMARY OF THE PRESENT INVENTION

The present invention relates generally to aquatic equipment and, more specifically, to an aquatic rescue station having life saving equipment for helping a person in distress in an aquatic environment. The aquatic rescue station includes a flotation device that is selectively detachable from a base that is located on a support pole securely positioned at or near the body of water. Upon selectively detaching the flotation device from the base, a plurality of alarm mechanisms are activated for notifying both people in the immediate vicinity and other public servants that there is a water emergency in progress and that a person is in distress. The alarm mechanisms can be at least one of visual, audible, and via radio frequency.

A primary object of the present invention is to provide an aquatic rescue station that overcomes the shortcomings of the prior art.

Another object of the present invention is to provide an aquatic rescue station including at least one flotation device mounted on and selectively detachable from a base.

A further object of the present invention is to provide an aquatic rescue station wherein the base is mounted on a support pole that extends upward from a location near the shoreline, water edge, or poolside with a floatation device mounted thereon having a predetermined length of rope attached thereto so a rescuer can pull a victim to safety.

An even further object of the present invention is to provide an aquatic rescue station that includes an anti-theft mechanism for preventing improper use and removal of the flotation device from the base.

Yet another object of the present invention is to provide an aquatic rescue station that can be positioned at any desired point in, around or near a body of water or pool.

Another object of the present invention is to provide an aquatic rescue station that includes a triggering mechanism which is activated upon removing the flotation device from the base.

A further object of the present invention is to provide an aquatic rescue station that includes a notification mechanism that is activated by the triggering mechanism to notify people in the immediate vicinity that a water emergency is in progress and that a person is in distress and requires assistance.

Still a further object of the present invention is to provide an aquatic rescue station wherein the notification mechanism that is attached by the triggering mechanism is an audible sound emanating from speakers positioned on the base.

Yet another object of the present invention is to provide an aquatic rescue station wherein notification mechanism is a visual signal emanating from a light positioned on the support pole.

Still yet another object of the present invention is to provide an aquatic rescue station further including a transmitter for transmitting a distress signal to the local authorities thereby notifying them that a water emergency is in progress.

A further object of the present invention is to provide an aquatic rescue station that includes a global positioning system connected to the flotation device so that the movement of the flotation device can be easily tracked and located.

An even further object of the present invention is to provide an aquatic rescue station wherein the triggering mechanism is a hook which holds the flotation device in place and upon removing the flotation device from the hook; the hook is caused to move from a first inactive position to a second active position for triggering the notification mechanism.

Yet an even further object of the present invention is to provide an aquatic rescue station wherein the triggering mechanism is a cord that is connected to both the flotation device and the base, and upon the cord being separated from the flotation device or the base, the notification mechanism is triggered.

Still another object of the present invention is to provide an aquatic rescue station that is simple and easy to use.

Still yet another object of the present invention is to provide mechanism that is inexpensive to manufacture and use.

Additional objects of the present invention will appear as the description proceeds.

The present invention overcomes the shortcomings of the prior art by providing an aquatic rescue station that includes at least one flotation device that is removably mounted on a base. The base is mounted on a support pole or other structure that is positioned near or in a body of water. The aquatic rescue station includes a triggering mechanism that triggers a notification mechanism to emit at least one of an audible and visual signal upon the flotation device being removed from the base. These signals function to alert people in the immediate vicinity that a water emergency is in progress and that a swimmer needs assistance. Additionally, the base includes a communication device, such as a radio frequency transmitter, phone line, or digital/cellular phone technology for transmitting a distress signal to the local authorities when the flotation device has been removed from the base. The audible and visual signals, along with the communication device can also function as an anti-theft device thereby ensuring that the flotation devices will not be misused or stolen.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
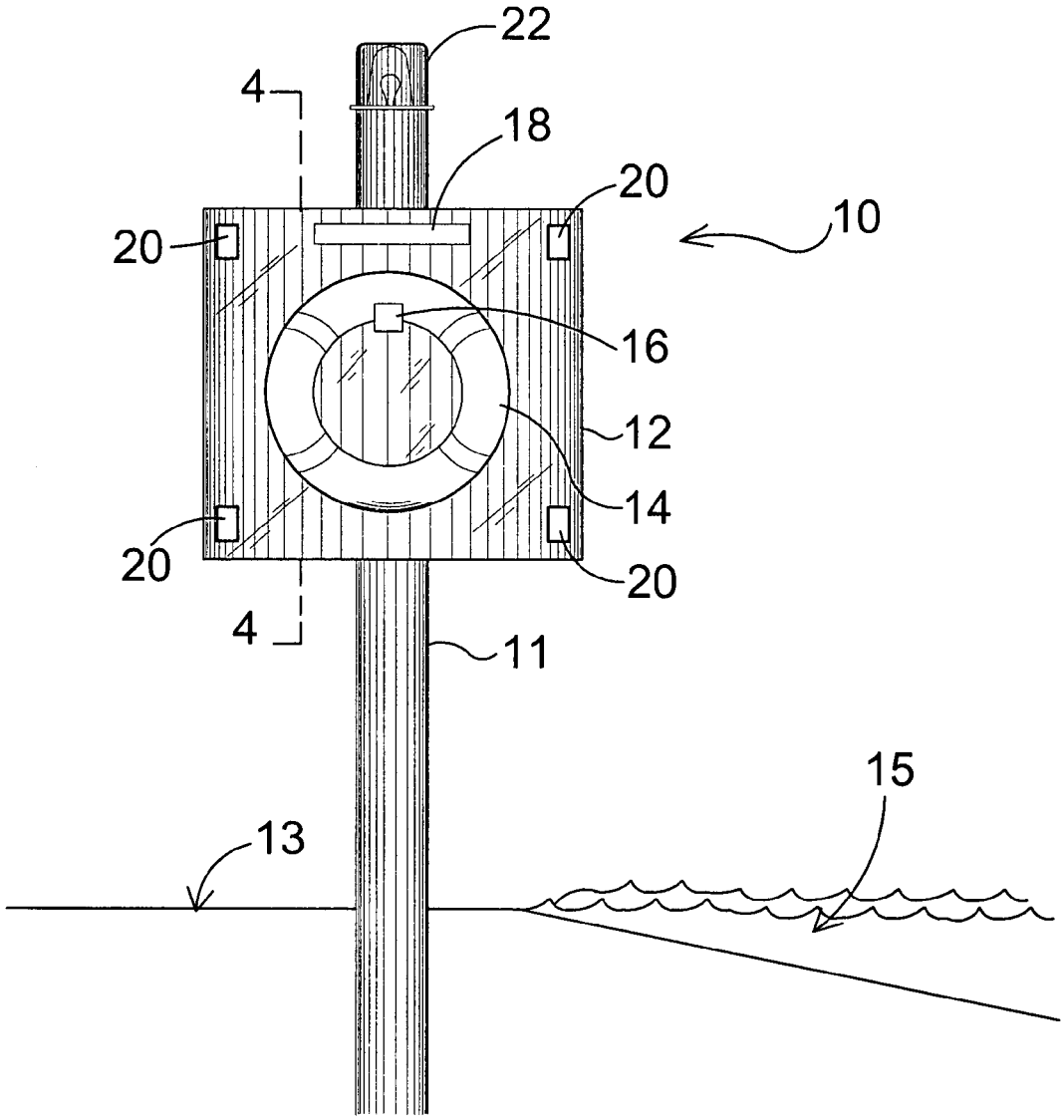
FIG. 1 is an illustrative view of the aquatic rescue station of the present invention positioned on the shoreline.

Turning now descriptively to the drawings, in which similar reference characters denote similar elements throughout the several views, the Figures illustrate the aquatic rescue station of the present invention. With regard to the reference numerals used, the following numbering is used throughout the various drawing Figures.

10 aquatic rescue station of the present invention
11 support pole
12 base
13 ground
14 flotation device
15 water
16 triggering mechanism
18 housing
20 speaker
21 alarm sound
22 lamp
23 light
24 distressed person
26 processor

28 power source
30 transmitter
32 distress signal
34 hook
36 first connection point
38 detachable cord
40 second connection point
42 buoy
44 ring buoy
46 rescue tube
48 rescue can
52 lifeline
54 rescuer

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 12 illustrate an aquatic rescue station of the present invention indicated generally by the numeral 10.

FIG. 1 is an illustrative view of the aquatic rescue station 10 of the present invention positioned on the shore. The aquatic rescue station 10 includes a base 12 connected to a support pole 11. The support pole 111 is anchored into the ground 13 in close proximity to a body of water 15. The base 12 includes a flotation device 14 that rests on a triggering mechanism 16. The triggering mechanism 16 is connected to a housing 18, which includes a conventional alarm mechanism. The support pole also includes a lamp 22 at an end opposite the ground 13. When the flotation device 14 is removed, the triggering mechanism 16 activates the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 2:
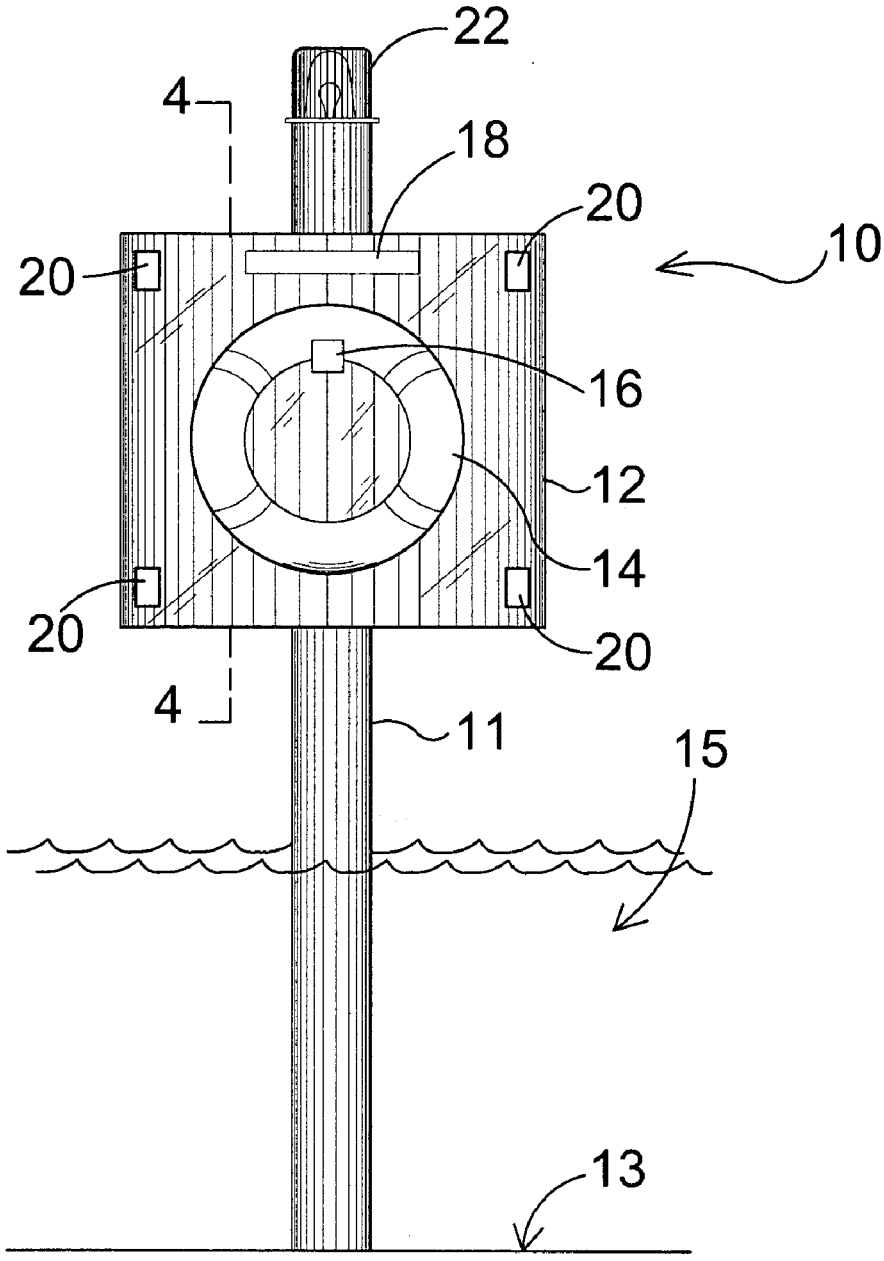
FIG. 2 is an illustrative view of the aquatic rescue station of the present invention positioned in a body of water.

FIG. 2 is an illustrative view of the aquatic rescue station 10 of the present invention positioned in a body of water. The aquatic rescue station 10 includes a base 12 connected to a support pole 11. The support pole 11 is anchored into the ground 13 beneath the surface of a body of water 15. The base 12 includes a flotation device 14 that rests on a triggering mechanism 16. The triggering mechanism 16 is connected to a housing 18, which includes a conventional alarm mechanism. The support pole also includes a lamp 22 at an end opposite the ground 13. When the flotation device 14 is removed, the triggering mechanism 16 activates the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 3:
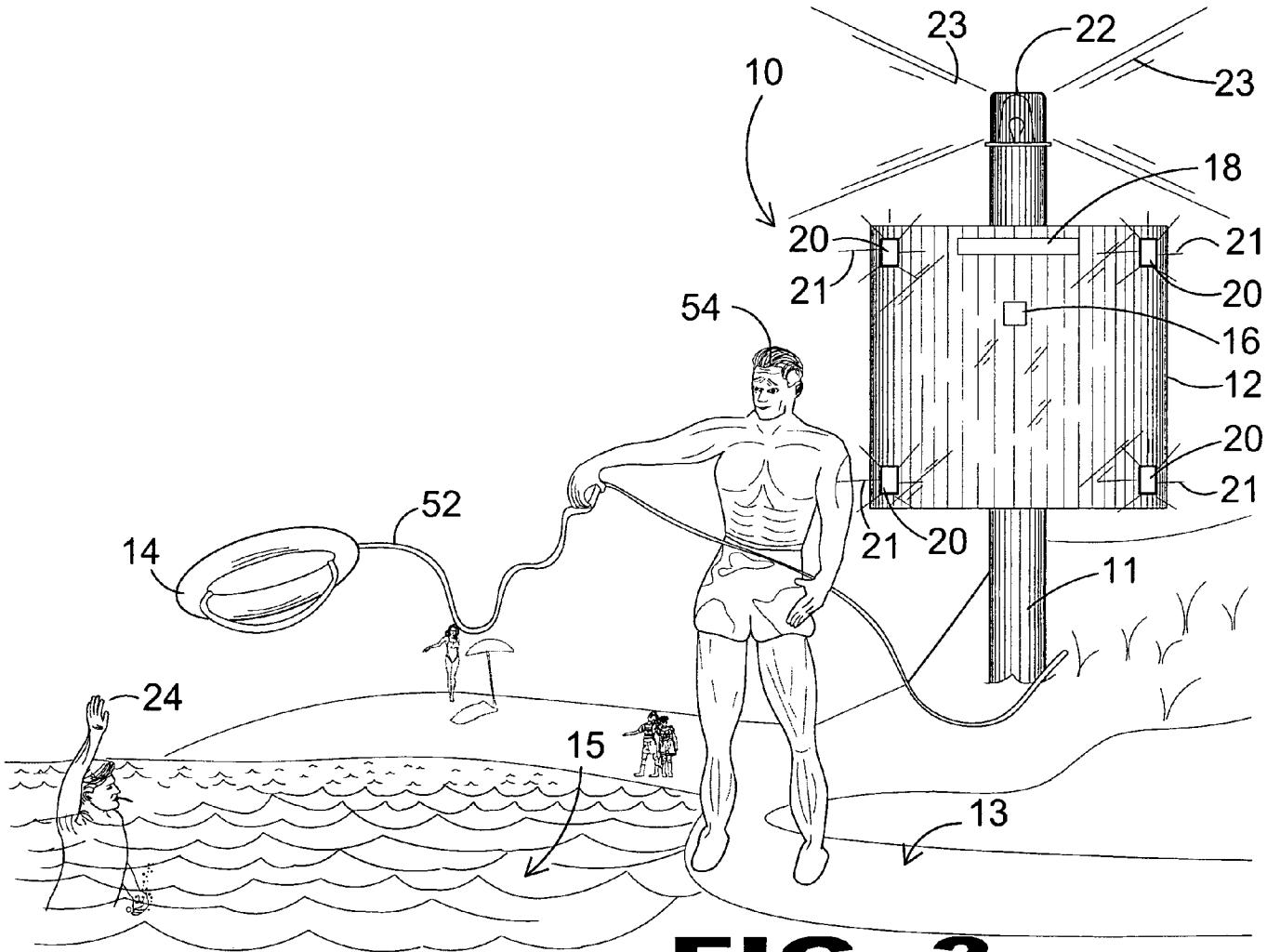
FIG. 3 is an illustrative view of the aquatic rescue station of the present invention in use.

FIG. 3 is an illustrative view of the aquatic rescue station 10 of the present invention in use. The aquatic rescue station 10 includes a base 12 connected to a support pole 11. The support pole 11 is anchored into the ground 13 in close proximity to a body of water 15. The base 12 includes a flotation device 14 that rests on a triggering mechanism 16. The triggering mechanism 16 is connected to a housing 18, which includes a conventional alarm mechanism. As shown in FIG. 3, the flotation device 14 is removed and thrown by a rescuer 54 to a distressed person 24. When the flotation device 14 is removed, the triggering mechanism 16 activates the alarm mechanism in the housing 18. The alarm mechanism in the housing 18 causes the speakers 20 to emit a sound. The alarm sound is indicated by the lines marked by the reference numeral 21. The alarm mechanism in the housing 18 also causes the lamp 22 to be illuminated. The light emitted by the lamp 22 is indicated by the lines marked by the reference numeral 23. The alarm sound 21 emitted by the speakers 20 and the light 23 emitted by the illuminated lamp 22 alerts lifeguards and others within a proximity of the aquatic rescue station 10 that the flotation device 14 has been thrown to a distressed person 24.

Figure 4:
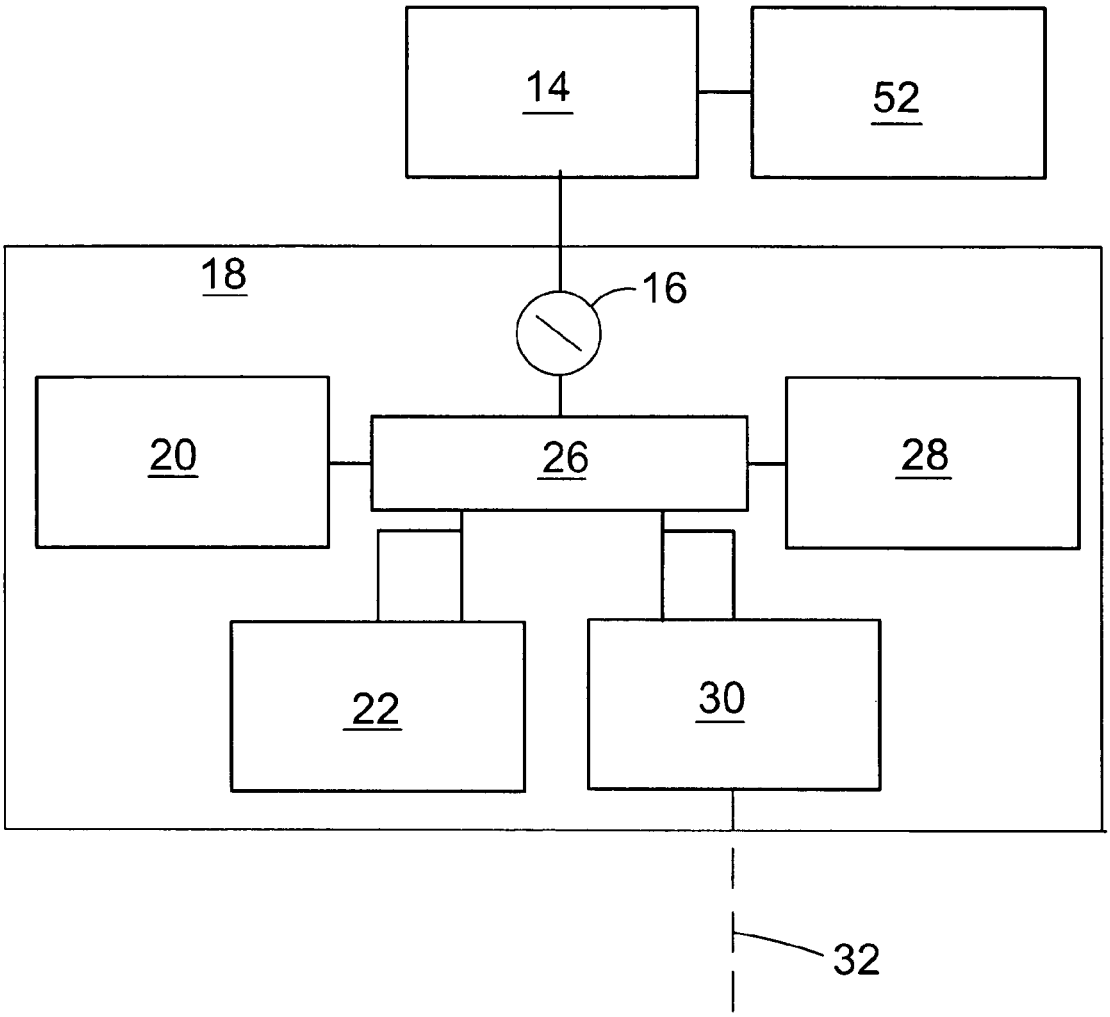
FIG. 4 is a block diagram of the aquatic rescue station of the present invention.

FIG. 4 is a block diagram of the aquatic rescue station 10 of the present invention. The housing 18 includes the components of the alarm mechanism of the aquatic rescue station 10. A power source 28 provides power to the aquatic rescue station 10. A processor 26 is connected to the triggering device 16 and at least one of speakers 20, lamp 22, and a transmitter 30. The flotation device 14 is attached to a lifeline 52, which can be used to pull the distressed person 24 to safety as illustrated in FIG. 3. When the flotation device 14 is removed from the triggering mechanism 16, the triggering mechanism 16 signals the processor 26 to cause the speaker 20 to emit an alarm sound 21 as illustrated in FIG. 3. Preferably, the processor 26 also signals the lamp 22 to be illuminated as illustrated in FIG. 3. In an alternate embodiment, the processor 26 also signals the transmitter 30 to transmit a wireless signal to a receiver positioned at a distant station, thereby alerting rescuers or authorities that the flotation device 14 has been removed from the triggering mechanism 16.

Figure 5:
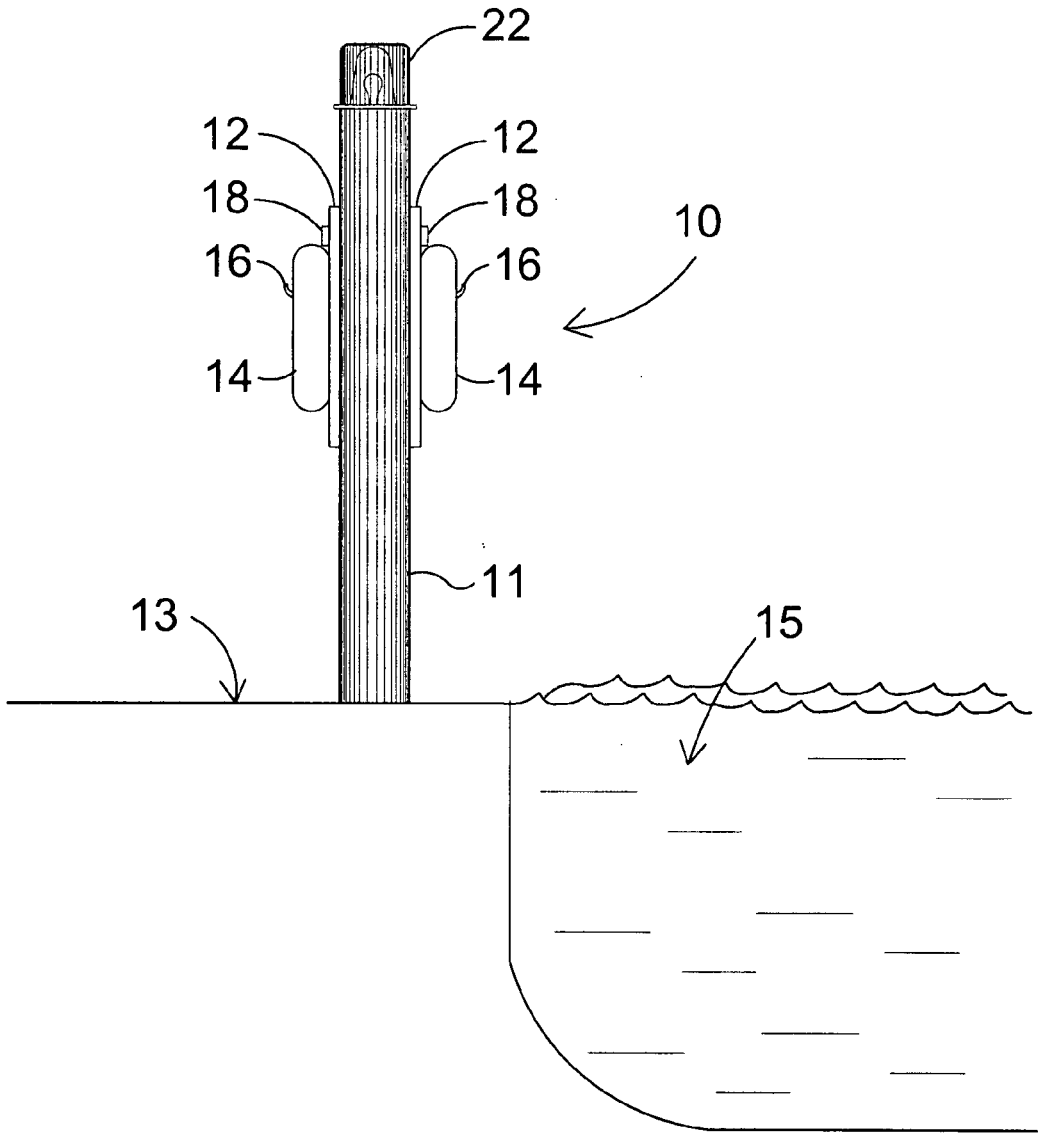
FIG. 5 is a side view of the aquatic rescue station of the present invention positioned landside.

FIG. 5 is a side view of the aquatic rescue station 10 of the present invention positioned landside. The aquatic rescue station 10 includes a base 12 connected to a support pole 11. The support pole 11 is anchored into the ground 13 in close proximity to a body of water 15. FIG. 5 illustrates the aquatic rescue station 10 anchored into the cement surrounding a pool. The base 12 includes a flotation device 14 that rests on a triggering mechanism 16. The triggering mechanism 16 is connected to a housing 18, which includes a conventional alarm mechanism. The support pole also includes a lamp 22 at an end opposite the ground 13. When the flotation device 14 is removed, the triggering mechanism 16 activates the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 6:
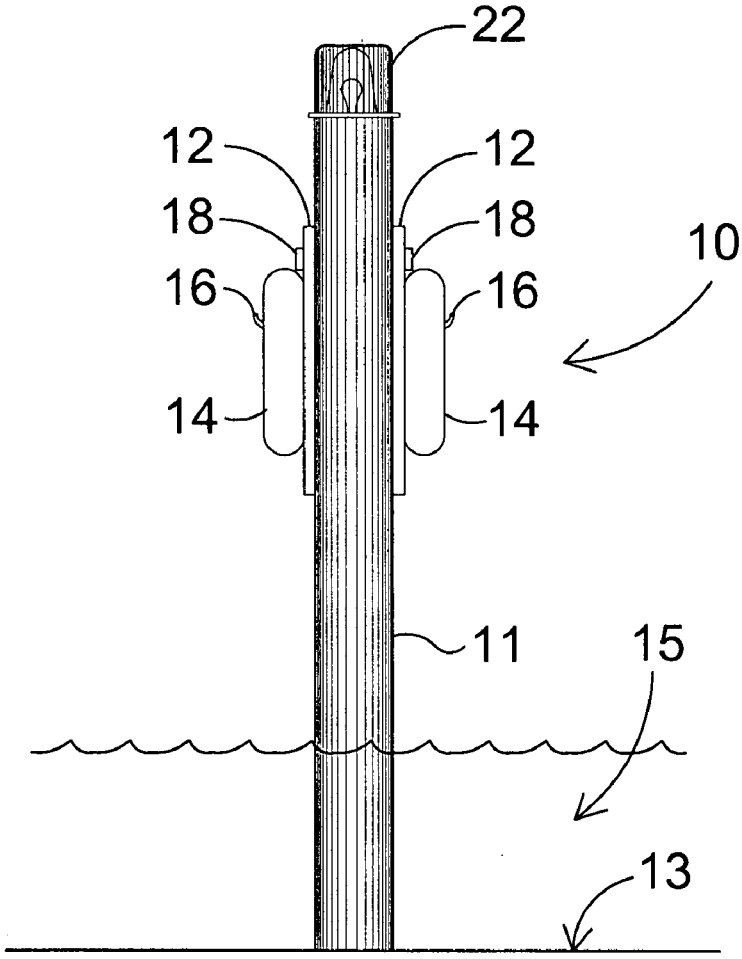
FIG. 6 is a side view of the aquatic rescue station of the present invention positioned in a body of water.

FIG. 6 is a side view of the aquatic rescue station of the present invention positioned in a body of water. The aquatic rescue station 10 includes a base 12 connected to a support pole 11. The support pole 11 is anchored into the ground 13 beneath the surface of a body of water 15. The base 12 includes a flotation device 14 that rests on a triggering mechanism 16. The triggering mechanism 16 is connected to a housing 18, which includes a conventional alarm mechanism. The support pole also includes a lamp 22 at an end opposite the ground 13. When the flotation device 14 is removed, the triggering mechanism 16 activates the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 7:
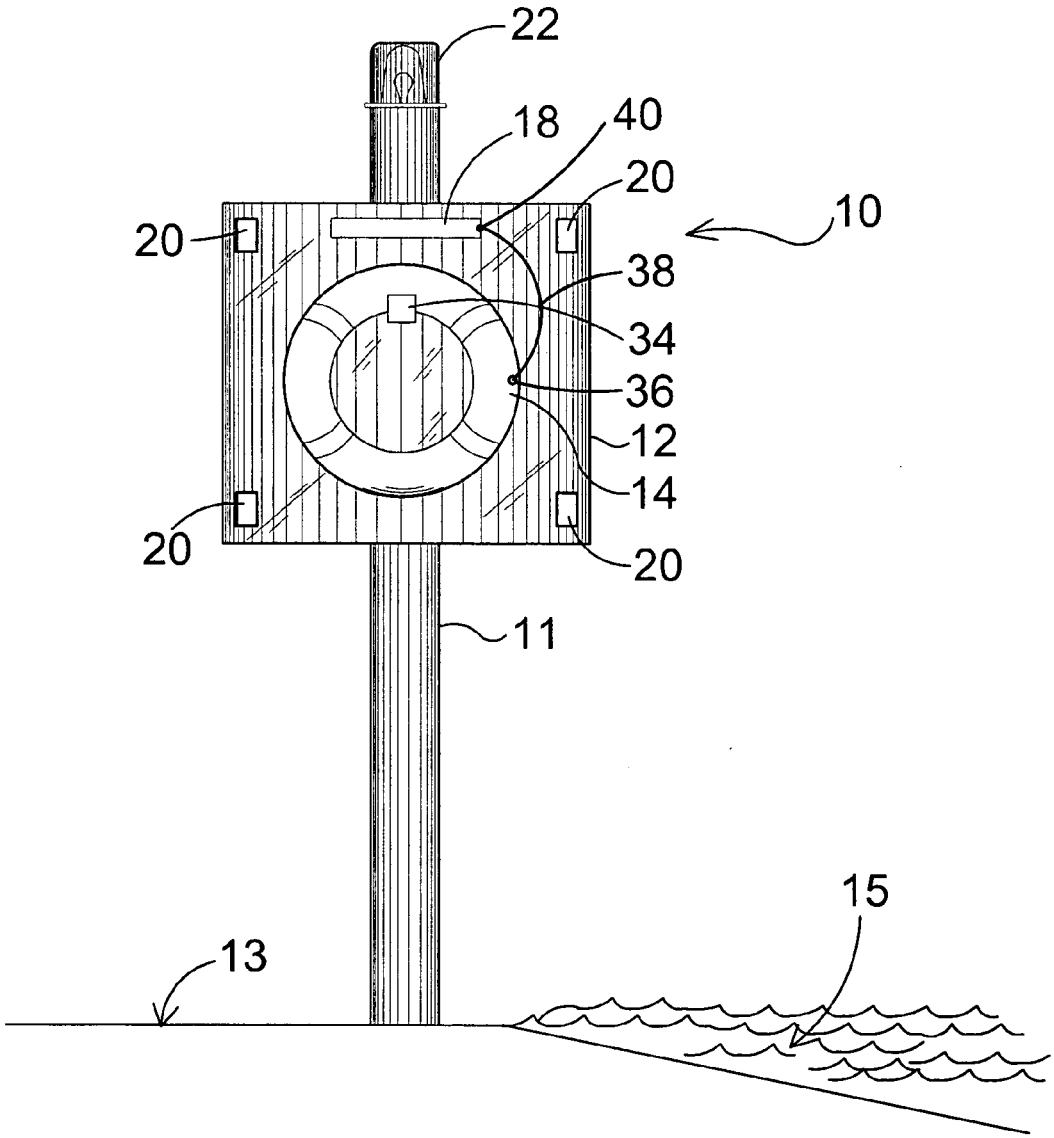
FIG. 7 is a front view of the aquatic rescue station of the present invention positioned on land having a detachable cord triggering mechanism.

FIG. 7 is a front view of the aquatic rescue station 10 of the present invention positioned on land having a detachable cord triggering mechanism. The aquatic rescue station 10 includes a base 12 connected to a support pole 11. The support pole 11 is anchored into the ground 13 in close proximity to a body of water 15. The base 12 includes a flotation device 14 which rests on a hook 34 and is connected to a housing 18 by a detachable cord 38. The detachable cord 38 is connected to the flotation device 14 at a first connection point 36 and releasably attached to the housing 18 at a second connection point 40. When the flotation device 14 is removed and thrown, the detachable cord 38 is removed from the housing 18, thereby activating the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 8:
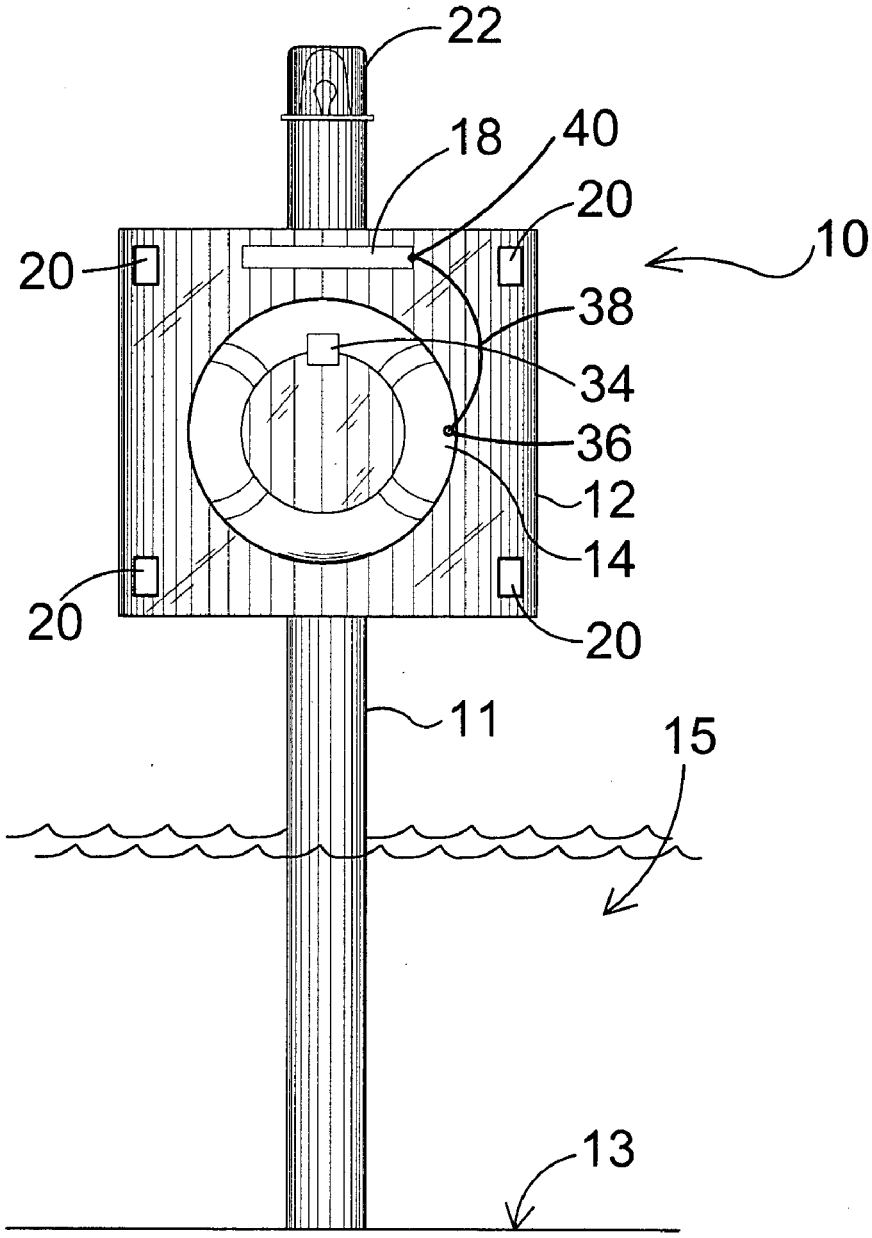
FIG. 8 is a front view of the aquatic rescue station of the present invention positioned in a body of water having a detachable cord triggering mechanism.

FIG. 8 is a front view of the aquatic rescue station of the present invention positioned in a body of water having a detachable cord triggering mechanism. The aquatic rescue station 10 includes a base 12 connected to a support pole 11. The support pole 11 is anchored into the ground 13 beneath the surface of a body of water 15. For example, the support pole can be anchored into the cement under the water in the deep end of a large pool. The base 12 includes a flotation device 14 which rests on a hook 34 and is connected to a housing 18 by a detachable cord 38. The detachable cord 38 is connected to the flotation device 14 at a first connection point 36 and releasably attached to the housing 18 at a second connection point 40. When the flotation device 14 is removed and thrown, the detachable cord 38 is removed from the housing 18, thereby activating the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14.

Figure 9:
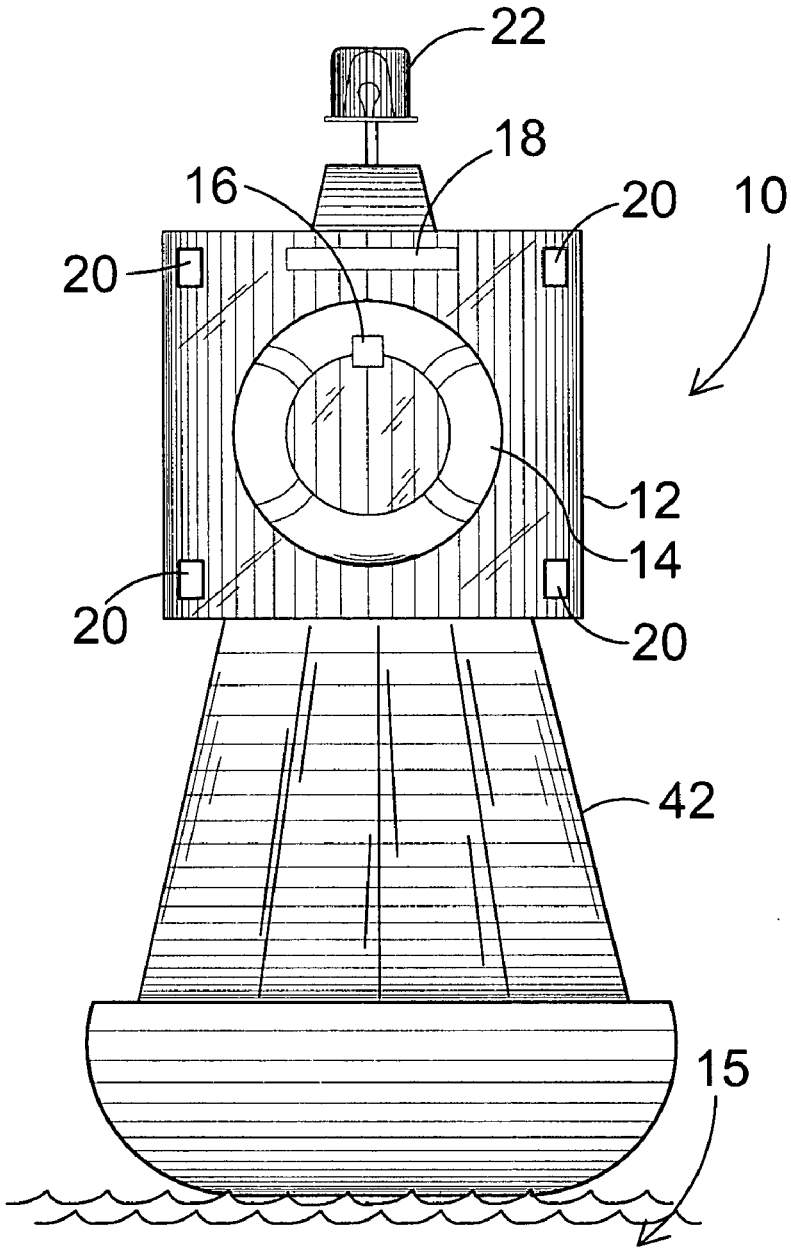
FIG. 9 is an illustrative view of the aquatic rescue station of the present invention mounted on a floating buoy.

FIG. 9 is an illustrative view of the aquatic rescue station 10 of the present invention mounted on a floating buoy. The aquatic rescue station 10 includes a base 12 connected to floating buoy 42. The floating buoy 42 is useful when the body of water 15 is too deep to practically anchor the aquatic rescue device 10 into the ground beneath the surface of the body of water 15. The base 12 includes a flotation device 14 that rests on a triggering mechanism 16. The triggering mechanism 16 is connected to a housing 18, which includes a conventional alarm mechanism. The support pole also includes a lamp 22 at an end opposite the ground 13. When the flotation device 14 is removed, the triggering mechanism 16 activates the alarm mechanism in the housing 18. The alarm mechanism causes the speakers 20 to emit a sound and the lamp 22 to be illuminated. The sound emitted by the speakers 20 and the illuminated lamp 22 alert lifeguards and any other people in proximity to the aquatic rescue station 10 that the flotation device 14 has been thrown to someone in distress. The sound emitted by the speakers 20 and the illuminated lamp 22 may also alert those in the nearby area if someone is attempting to steal the flotation device 14. Preferably, components of the housing 18 also cause a transmitter to transmit a distress signal to nearby radios, thereby alerting those unable to hear the sound of the speakers 20 or see the illumination of the lamp 22.

Figure 10:
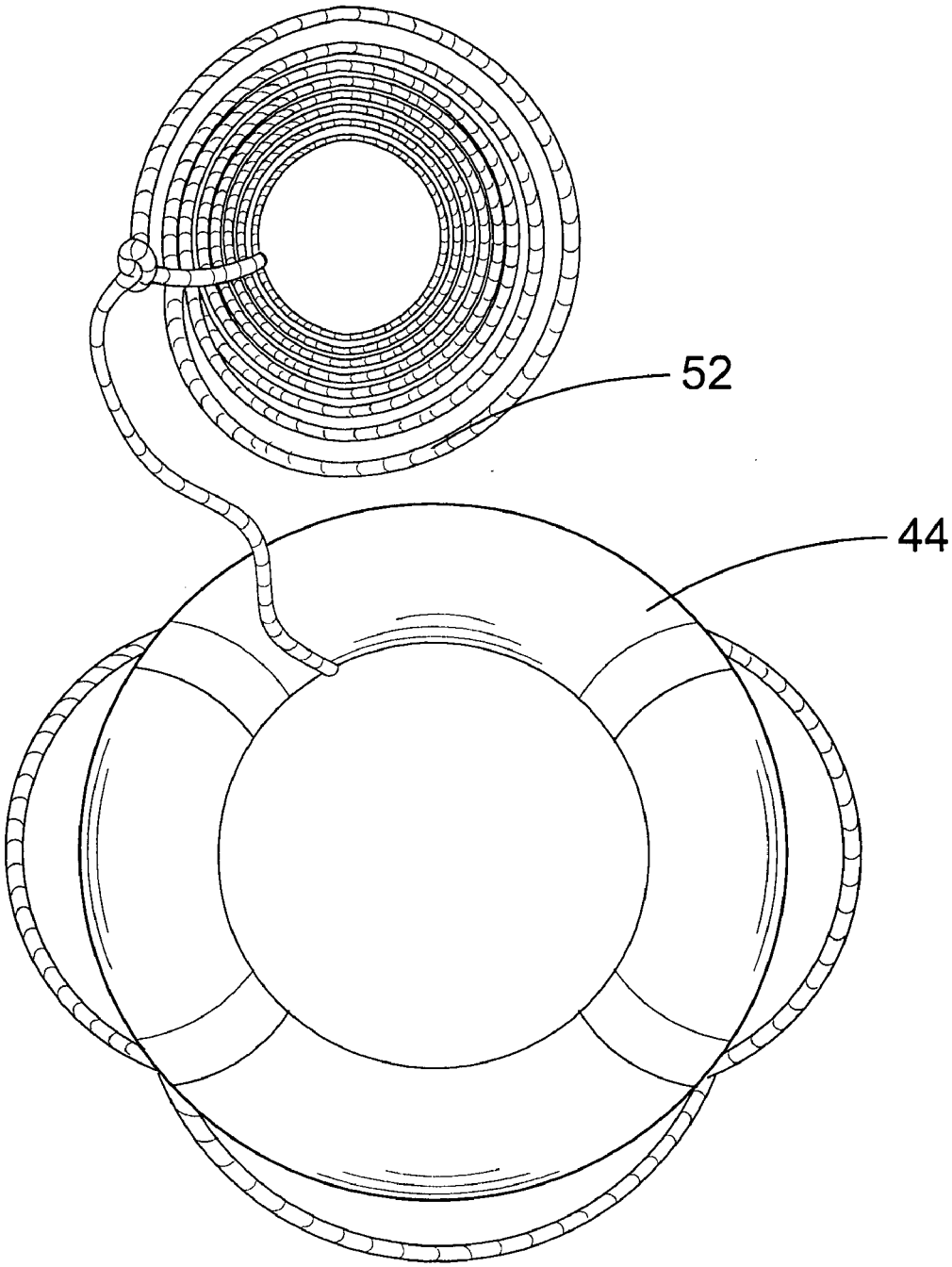
FIG. 10 is front view of a ring buoy flotation device.

FIG. 10 is front view of a ring buoy flotation device. As shown in FIG. 10, the flotation device of the present invention may be a ring buoy 44. The ring buoy 44 is attached to a lifeline 52, which can be used to pull the distressed person 24 to safety as illustrated in FIG. 3. Preferably, the ring buoy 44 rests on the triggering mechanism 16 as illustrated in FIGS. 1–3, 5–6, and 9. Alternately, the ring buoy 44 rests on the hook 34 and is attached to the housing 18 via the detachable cord 38, as illustrated in FIGS. 7–8.

Figure 11:
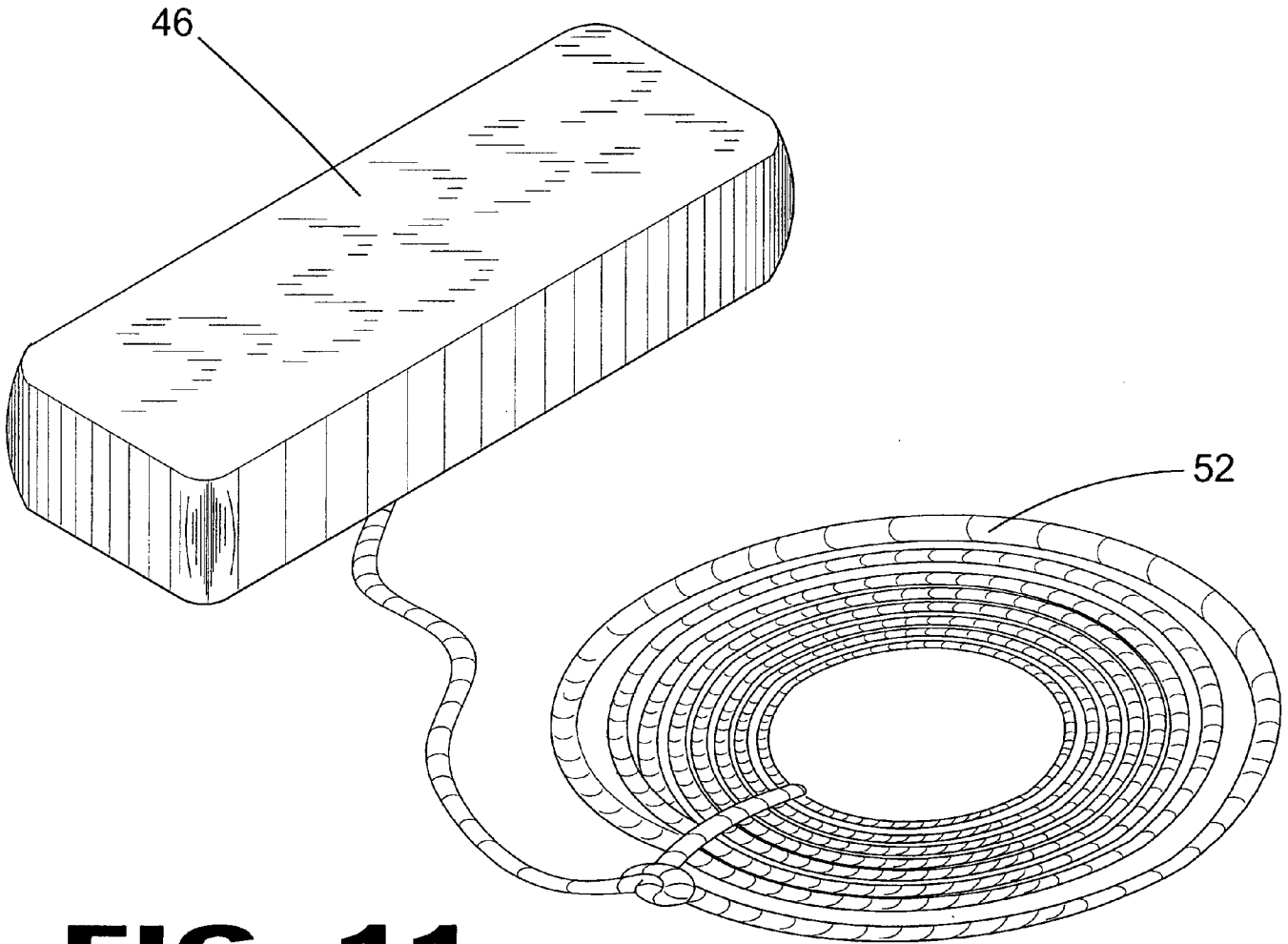
FIG. 11 is a front view of a rescue tube flotation device.

FIG. 11 is a front view of a rescue tube flotation device. As shown in FIG. 11, the flotation device of the present invention may be a rescue tube 46. The rescue tube 46 is attached to a lifeline 52, which can be used to pull the distressed person 24 to safety as illustrated in FIG. 3. Preferably, the rescue tube 46 rests on the triggering mechanism 16 as illustrated with the ring buoy embodiment in FIGS. 1–3, 5–6, and 9. Alternately, the rescue tube 46 rests on the hook 34 and is attached to the housing 18 via the detachable cord 38, as illustrated with the ring buoy embodiment in FIGS. 7–8.

Figure 12:
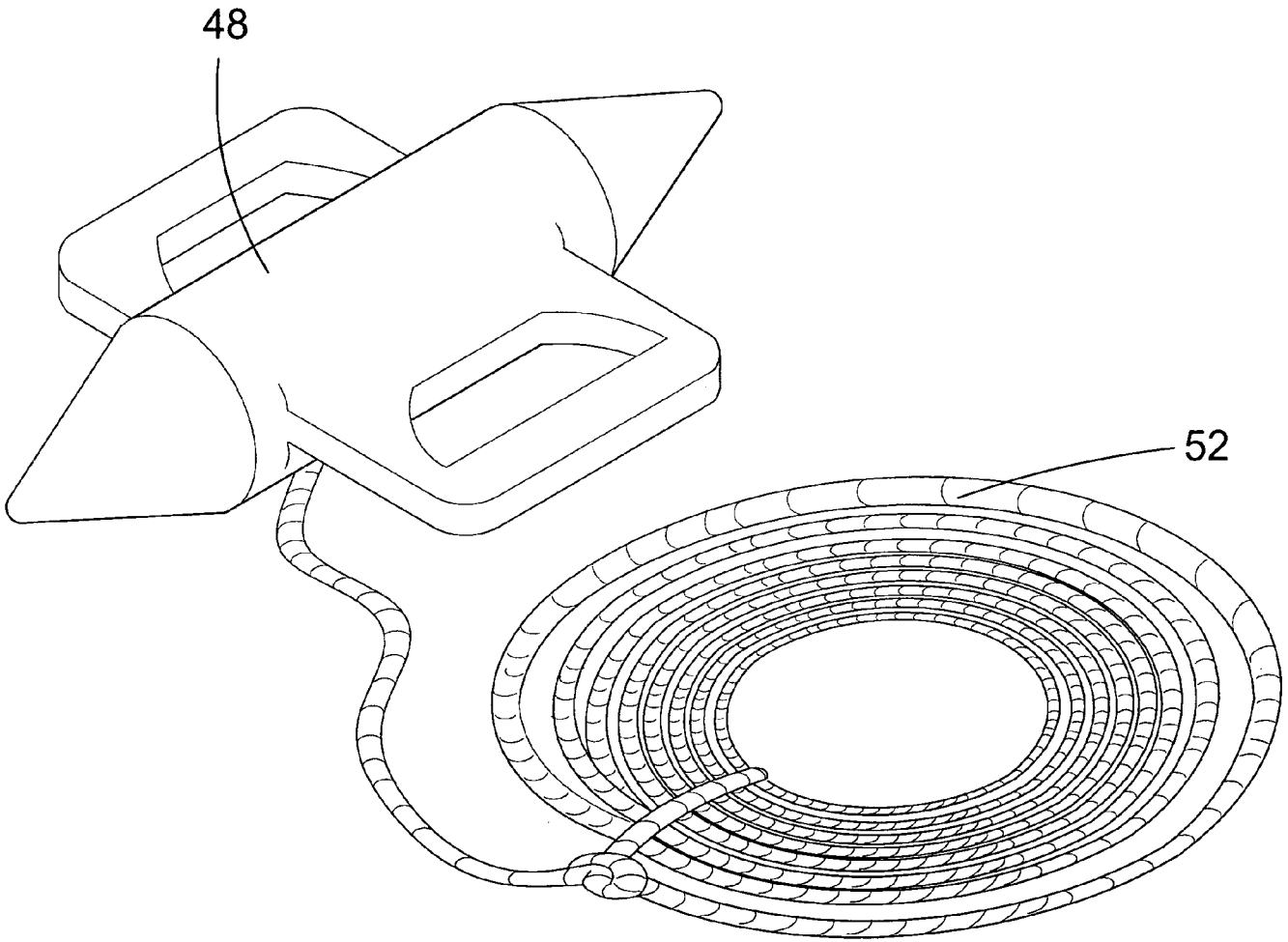
FIG. 12 is a front view of a rescue can flotation device.

FIG. 12 is a front view of a rescue can flotation device. As shown in FIG. 12, the flotation device of the present invention may be a rescue can 48. The rescue can 48 is attached to a lifeline 52, which can be used to pull the distressed person 24 to safety as illustrated in FIG. 3. Preferably, the rescue can 48 rests on the triggering mechanism 16 as illustrated with the ring buoy embodiment in FIGS. 1–3, 5–6, and 9. Alternately, the rescue can 48 rests on the hook 34 and is attached to the housing 18 via the detachable cord 38, as illustrated with the ring buoy embodiment in FIGS. 7–8. The rescue can 48 is the preferred embodiment of the flotation device for lifeguards who hold the rescue can 48 by the handles while swimming out to a distressed person.

It will be understood that each of the elements described above, or two or more together may also find a useful application in other types of methods differing from the type described above.

While certain novel features of this invention have been shown and described and are pointed out in the to the annexed claims, it is not intended to be limited details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An aquatic rescue apparatus comprising:

a) a base;

b) a housing connected to said base, said housing includes at least one alarm mechanism contained therein;

c) a triggering mechanism positioned on said housing and connected to said alarm mechanism; and d) a flotation device releasably connected to said triggering mechanism, wherein upon said flotation device being removed from said triggering mechanism, said at least one alarm mechanism emits an alarm signal indicative of an aquatic emergency, wherein said triggering mechanism comprises a detachable cord connected to said flotation device and releasably connected to said housing wherein removal of the detachable cord from said housing activates said at least one alarm mechanism.

2. The apparatus as recited in claim 1, wherein said at least one alarm mechanism comprises an audible alarm.

3. The apparatus as recited in claim 1, wherein said at least one alarm mechanism comprises a visual alarm.

4. The apparatus as recited in claim 3, wherein said visual alarm comprises a rotating emergency light.

5. The apparatus as recited in claim 1, wherein said at least one alarm mechanism comprises a radio transmitter.

6. The apparatus as recited in claim 5, wherein said radio transmitter transmits a distress signal for receipt by a radio receiver of rescue personnel.

7. The apparatus as recited in claim 1, further comprising a support pole wherein said base is mounted on said support pole.

8. The apparatus as recited in claim 7, wherein said support pole is anchored in the ground in at least one of proximity of a body of water and within a body of water.

9. The apparatus as recited in claim 1, wherein said base is connected to a buoy.

10. The apparatus as recited in claim 1, wherein said flotation device comprises a ring buoy.

11. The apparatus as recited in claim 1, wherein said flotation device comprises a rescue tube.

12. The apparatus as recited in claim 1, wherein said flotation device comprises a rescue can.

13. The apparatus as recited in claim 1, wherein said at least one alarm mechanism is an anti-theft device.

14. An aquatic rescue apparatus a) a base;

b) a housing connected to said base, said housing includes at least one alarm mechanism contained therein;

c) a triggering mechanism positioned on said housing and connected to said alarm mechanism; and d) a flotation device releasably connected to said triggering mechanism, wherein upon said flotation device being removed from said triggering mechanism, said at least one alarm mechanism emits an alarm signal indicative of an aquatic emergency, wherein said triggering mechanism comprises a weight-sensitive hook wherein removal of the detachable cord from said weight-sensitive hook activates said at least one alarm mechanism.

* * * * *